US006430954B1

(12) United States Patent
Smith

(10) Patent No.: US 6,430,954 B1
(45) Date of Patent: Aug. 13, 2002

(54) ADJUSTABLE PROTECTIVE COVER FOR AN AIR CONDITIONER

(76) Inventor: Donald A. Smith, 704 S. McRoberts St., Mason, MI (US) 48854

( * ) Notice: Subject to any disclaimer, the term of this patent is extended or adjusted under 35 U.S.C. 154(b) by 0 days.

(21) Appl. No.: 09/690,663

(22) Filed: Oct. 17, 2000

(51) Int. Cl.[7] ..... F25D 23/02

(52) U.S. Cl. ..... 62/259.1; 206/320; 135/913; 165/134.1

(58) Field of Search ..... 52/3, 23, 106; 135/913; 160/201, 205, 206, 207, 214; 206/320, 321; 62/259.1; 150/154, 157, 165; 165/134.1

(56) References Cited

U.S. PATENT DOCUMENTS

| | | | | |
|---|---|---|---|---|
| 654,972 | A | * | 7/1900 | Haack |
| 1,057,400 | A | * | 4/1913 | Aronson |
| 1,058,142 | A | * | 4/1913 | Bernitt |
| 1,118,069 | A | * | 11/1914 | Stockley |
| 2,155,209 | A | * | 4/1939 | Walker |
| 2,155,330 | A | * | 4/1939 | Pottenger |
| 4,261,418 | A | * | 4/1981 | Helt et al. |
| 4,308,905 | A | | 1/1982 | Gallagher |
| 4,475,585 | A | * | 10/1984 | Hoeffken |
| 4,498,912 | A | | 2/1985 | Wagner |
| 4,730,423 | A | | 3/1988 | Hughes |
| 4,732,012 | A | | 3/1988 | Thorpe |
| 4,745,769 | A | | 5/1988 | Wooden, Jr. |
| 4,768,350 | A | | 9/1988 | Moran, Jr. |
| 5,226,264 | A | | 7/1993 | Walters |
| 5,437,134 | A | * | 8/1995 | Donnelly |
| 5,655,382 | A | | 8/1997 | Chen |
| 5,809,800 | A | * | 9/1998 | Deal |
| 6,158,175 | A | * | 12/2000 | Carter |
| 6,221,120 | B1 | * | 4/2001 | Bennington et al. |

* cited by examiner

*Primary Examiner*—Robert Canfield
(74) *Attorney, Agent, or Firm*—Dale J. Ream

(57) ABSTRACT

An adjustable protective cover for use with an outdoor air conditioning unit comprises a framework of vertical supports and upper and lower struts forming a generally cubicle configuration. The protective cover further includes a screen having a top portion and a plurality of side portions. The top portion spans between the upper struts for shielding the top of the air conditioning unit from the sun and debris. The side portions of the screen span between respective vertical supports and upper and lower struts for shielding the sides of the air conditioning unit from the sun and debris. A plurality of slider bars are fixedly attached along free edges of the side portions of the screen adjacent respective lower struts. Each vertical support defines a slot extending longitudinally therealong. The cover further includes a plurality of knob fasteners that are slidable within the slots and which are threadably connected to respective slider bars. Accordingly, each side portion of the screen may be moved between open and closed configurations relative to the upper and lower struts of the framework upon slidable movement of a respective fastener along a slot path. As the fastener may threadably tighten or loosen a slider bar relative to a vertical support, the side portions may be held in partially open or closed configurations.

10 Claims, 6 Drawing Sheets

ADJUSTABLE PROTECTIVE COVER FOR AN AIR CONDITIONER

BACKGROUND OF THE INVENTION

This invention relates generally to apparatus for increasing the efficiency of air conditioning units and, more particularly, to a protective cover for shielding the unit from the sun or debris which allows selective access to the air conditioning unit without removing the entire cover therefrom.

Intense heat or debris, such as leaves, grass, and the like, that becomes lodged in the vent panels of an air conditioning unit cause the unit to run inefficiently, wastes energy, and decreases the life of component parts. Many apparatus have been proposed in the art for shielding an air conditioning unit from the sun. Although assumably effective for their intended purposes, existing devices do not shield an air conditioning unit from both sun and debris while also permitting access to portions of the unit, such as for repair or maintenance, without completely removing the shielding apparatus.

Therefore, it is desirable to have a protective cover for an air conditioning unit which shields the unit from both sun and debris while still permitting air flow therethrough. Further, it is desirable to have a protective cover which allows convenient access to selected portions of the air conditioning unit without completely removing the apparatus from its shielding position.

SUMMARY OF THE INVENTION

An adjustable protective cover for use with an air conditioning unit according to the present invention includes a framework having a plurality of upstanding vertical supports with a plurality of horizontal upper struts connecting upper ends of the supports and a plurality of horizontal lower struts connecting lower ends of the supports. Therefore, the framework forms a generally cubicle-shaped configuration. A screen having a mesh adapted to significantly shield the air conditioning unit from sun or debris while still allowing air to flow therethrough is coupled to the framework. The screen includes a top portion that spans between the upper struts of the framework so as to shield the top of the air conditioning unit. The side portions of the screen span between adjacent vertical supports and between upper and lower struts. Each vertical support integrally includes two faces, the faces being normal to one another and each face defining a slot extending longitudinally between upper and lower ends thereof.

Only one edge of each side portion of the screen is fixedly attached to a respective strut. The protective cover further includes a plurality of slider bars, one slider bar being attached along a free edge of each side portion opposite the attached edge thereof. As the side portions of the screen are attached to upper struts, the free edges and slider bars thereof are adjacent respective lower struts and are parallel thereto. Each slider bar defines threaded apertures adjacent ends thereof that are configured for alignment with the slots. The invention further includes a plurality of knob fasteners, each fastener having a threaded tip configured to be inserted through a slot and to threadably engage a slider bar aperture. Therefore, each slider bar is engaged by two knob fasteners. Loosening the knob fasteners enables the knobs, slider bar, and side portion of the screen to be adjusted up or down between corresponding upper and lower struts. A tightening of selected knob fasteners secures the corresponding slider bar to the vertical supports at a desired position between the upper and lower struts. Accordingly, selected side portions may be moved between open, closed, or partially open configurations to permit access to the air conditioning unit without completely removing the cover from about the air conditioning unit.

Therefore, a general object of this invention is to provide a protective cover for shielding an outdoor air conditioning unit from direct rays of sun and from debris.

Another object of this invention is to provide a protective cover, as aforesaid, having a mesh screen configured to shield the top and sides of the air conditioning unit while still allowing air to flow therethrough.

Still another object of this invention is to provide a protective cover, as aforesaid, having a box-like framework which completely surrounds and shields the air conditioning unit.

Yet another object of this invention is to provide a protective cover, as aforesaid, in which the mesh screen may be slidably reconfigured relative to the framework so as to provide access to the air conditioning unit.

A further object of this invention is to provide a protective cover, as aforesaid, in which the mesh screen may be selectively positioned in open, closed, or partially open configurations relative to the framework.

A still further object of this invention is to provide a protective cover, as aforesaid, that is lightweight and sturdy.

A particular object of this invention is to provide a protective cover, as aforesaid, that is easy and economical to manufacture.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
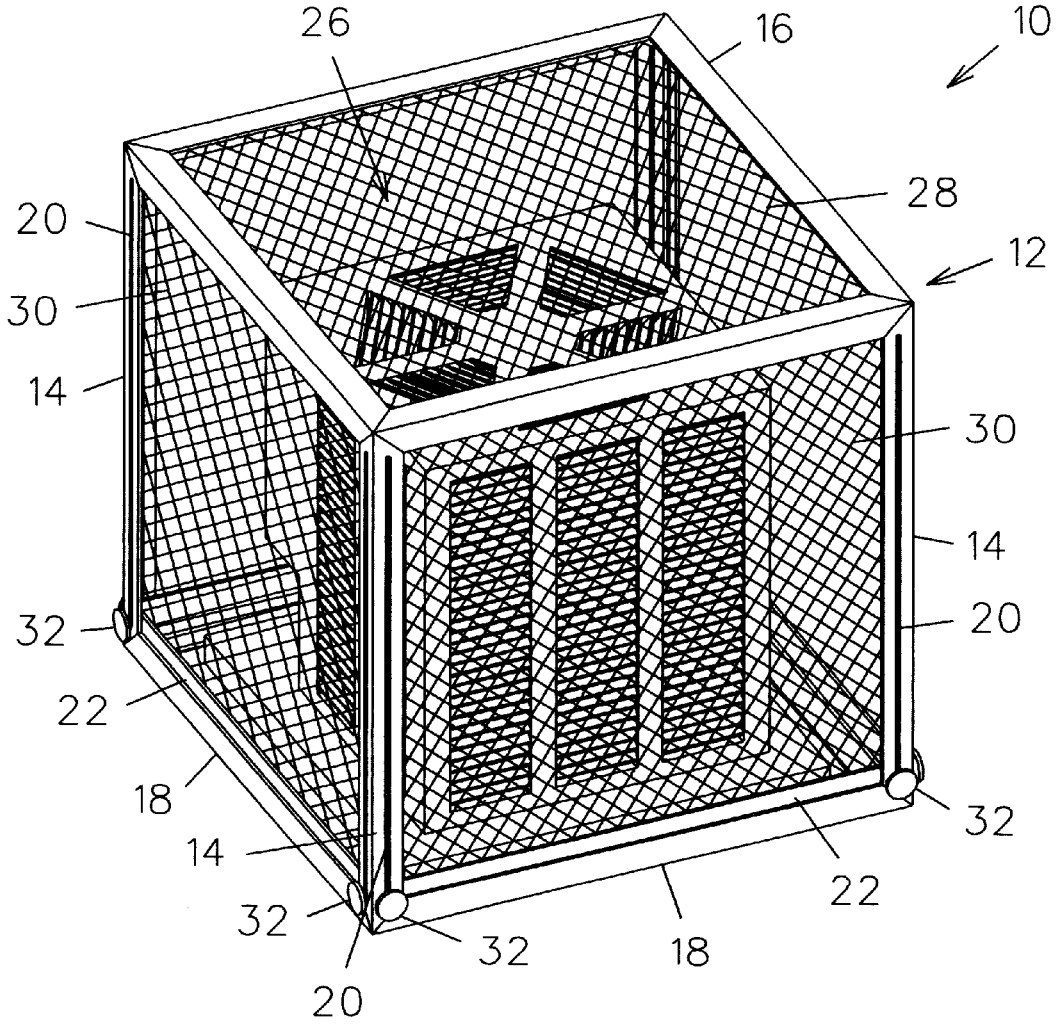
FIG. 1 is a perspective view of a protective cover according to one embodiment of the present invention.
Figure 2:
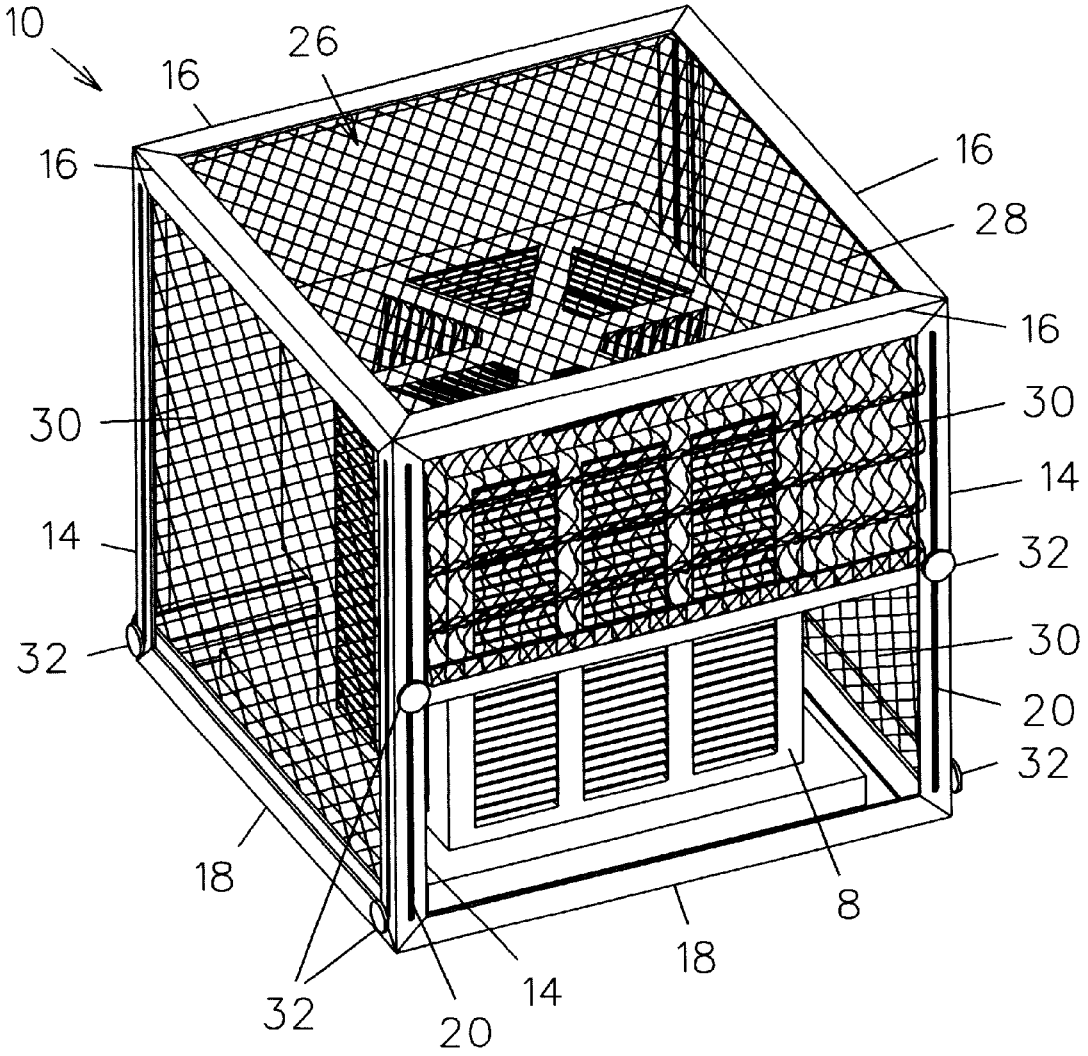
FIG. 2 is a perspective view of the cover as in FIG. 1 with one side portion of a screen in a partially open configuration.
Figure 3:
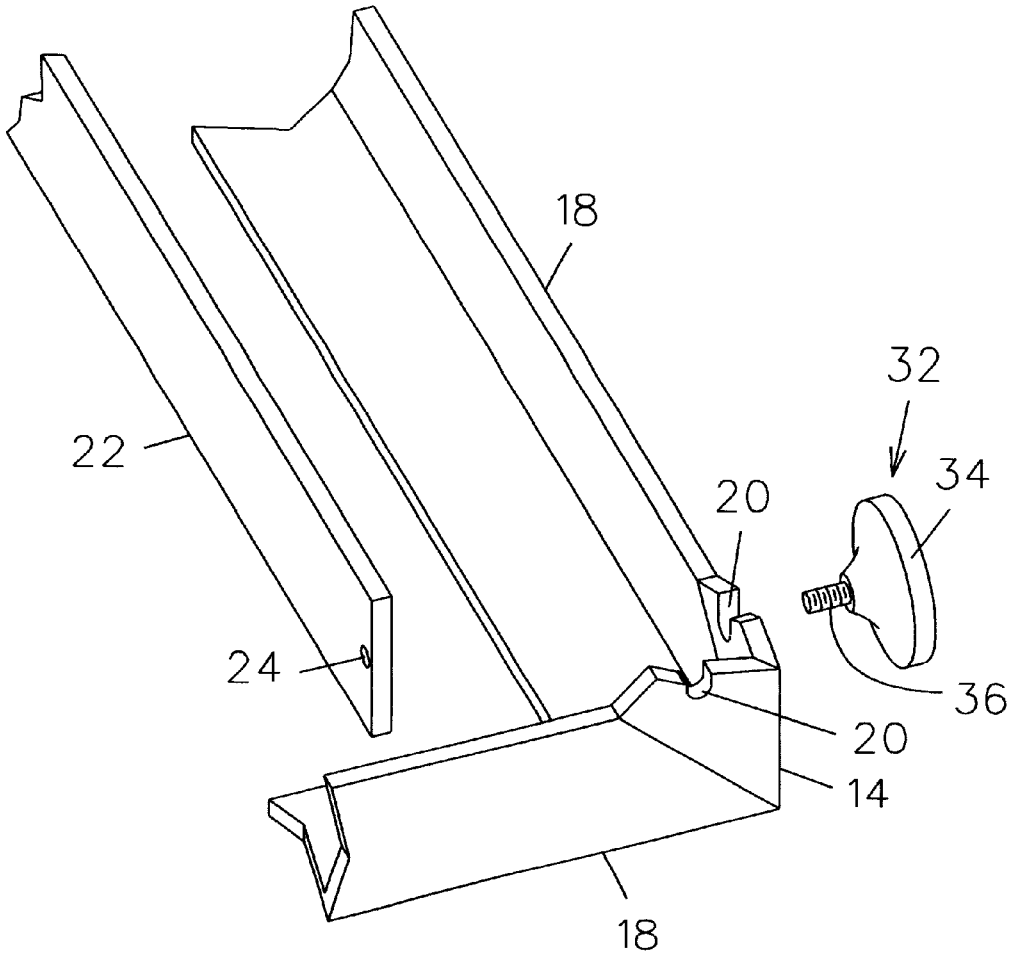
FIG. 3 is a fragmentary exploded view illustrating the connection between a slider bar, knob fastener, vertical support, and lower struts.

An adjustable protective cover for use in shielding an air conditioning unit 8 according to the present invention will now be described with reference to FIGS. 1–6 of the accompanying drawings. As shown in FIGS. 1–3, one embodiment of the protective cover 10 includes a framework 12 having four vertical supports 14 although the framework may include more supports depending on the particular configuration of the air conditioning unit 8 to be shielded. The vertical supports 14 are spaced apart such that the framework 12 will surround an outdoor air conditioning system having a conventional configuration (FIG. 1). The supports 14 have an upstanding configuration and include upper and lower ends. A plurality of upper struts 16 connect respective upper ends of the vertical supports 14. Similarly, a plurality of lower struts 18 connect lower ends of the vertical supports. The upper and lower struts each combine to form generally square configurations such that the framework 12 defines a box-like or cubicle configuration. Preferably, the framework 12 is constructed of angle iron although aluminum, plastic, or fiberglass would also be suitable materials if a lightweight construction is desired.

The protective cover 10 further includes a screen 26 constructed of a nylon mesh material that is coupled to the framework 12 for shielding the air conditioning unit 8 from direct rays of the sun and from debris such as leaves, grass, and the like. The density of the mesh material to be utilized in the cover 10 may be dependent upon the types of debris or flora common to a particular geographical region. The screen 26 includes a top portion 28 that completely spans between the upper struts 16. The screen 26 further comprises a plurality of side portions 30, each side portion 30 spanning between adjacent vertical supports 14 and respective upper and lower struts 16, 18. All edges of the top portion 28 are fixedly attached to corresponding upper struts 16 whereas only the upper edge of each side portion 30 is fixedly attached to a corresponding upper strut 16 with the remaining edges thereof depending therefrom and remaining unattached, as to be further described below.

Each vertical support 14 is an L-shaped piece of angle iron having a pair of outer faces normal one to the other (FIG. 1). Each face defines an elongate slot 20 extending longitudinally substantially between upper and lower ends of the support 14. The protective cover 10 further includes a plurality of elongate slider bars 22 (FIGS. 2 and 3). Each slider bar 22 includes a pair of ends and defines a threaded aperture 24 substantially adjacent each end. The upper longitudinal edge of each slider bar 22 is fixedly attached to the longitudinal free edge of each side portion of the screen such that each slider bar 22 is positioned inwardly rearward of a respective lower strut when the side portion 30 is at a closed configuration (FIG. 1). Each slider bar 22 is parallel to the corresponding lower strut 18 and configured such that the apertures 24 adjacent each end are inwardly aligned with the slot 20 of adjacent vertical supports 14 (FIG. 3).

Figure 4:
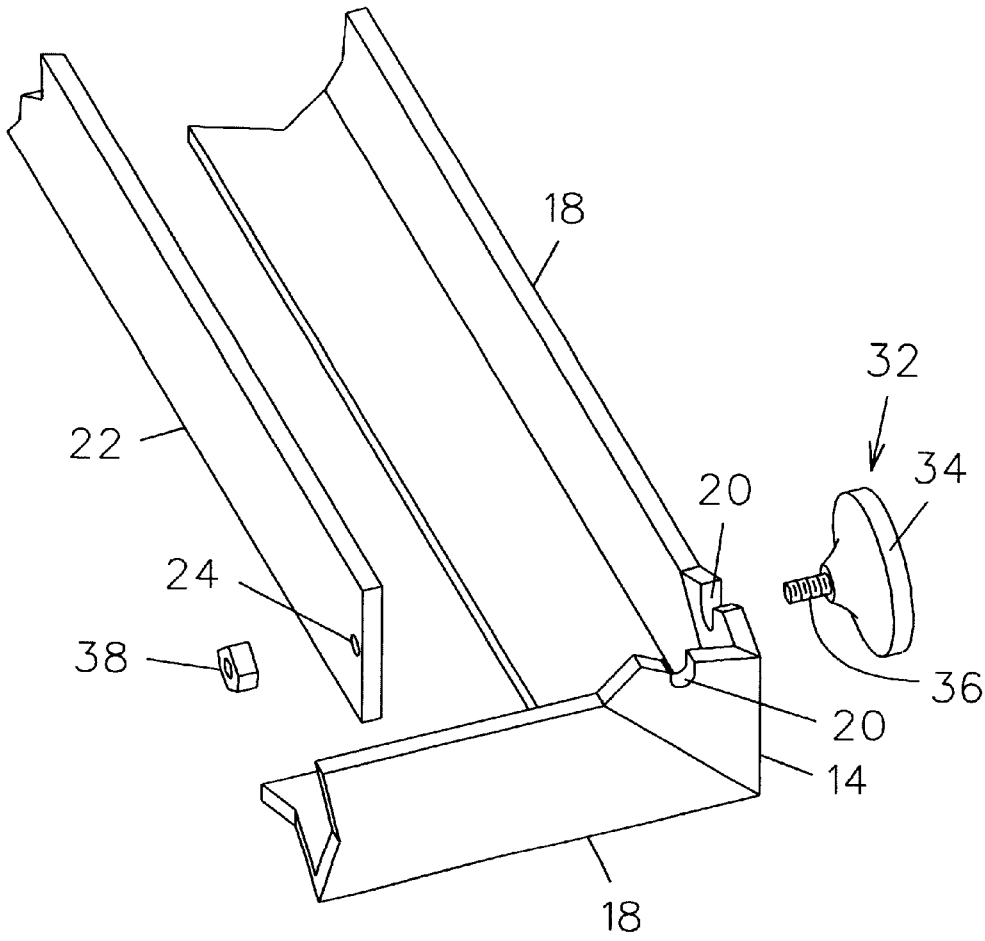
FIG. 4 is a fragmentary exploded view of another embodiment of the connections as in FIG. 3.

The protective cover 10 further includes a plurality of knob fasteners 32. Each fastener 32 includes a knob portion 34 that may be gripped by a user and a threaded member 36 configured to be inserted through a slot 20 for threaded engagement with a slider bar aperture 24 (FIG. 3). Therefore, as a knob fastener 32 is screwed into a threaded aperture 24, the corresponding slider bar 22 is tightened against the corresponding vertical support and vice versa. Alternatively, the threaded member 36 of a knob fastener 32 may extend through the slot and aperture and into a nut 38 for tightening or loosening a slider bar 22 relative to a vertical support 14. This configuration eliminates the need for the slider bar aperture 24 to be threaded (FIG. 4).

In use, the entire protective cover 10 is positioned over the air conditioning unit 8 as in FIG. 1. With all of the side portions 30 of the screen 26 in closed configurations, the top and sides of the air conditioning unit are shielded from the sun and debris. Obviously, the cover may be positioned over the unit in that the screen does not span between the lower struts. To gain access to the air conditioning unit 8 without completely removing the cover 10 from its position surrounding the unit, a user may turn adjacent knob fasteners 32 in a counter-clockwise direction so as to loosen the corresponding slider bar 22 from the adjacent vertical supports 14. Once loosened, the knob fasteners 32 are slidable along the paths of respective slots 20. The slider bar 22 connected to a corresponding lower free edge of a respective side portion of said screen is consequently moved between upper and lower struts which moves the corresponding screen side portion between open and closed configurations (FIG. 2). At a desired position, the knob fasteners 32 may be rotated in a clockwise direction for again tightening the slider bar 22 to corresponding vertical supports 14.

Figure 5:
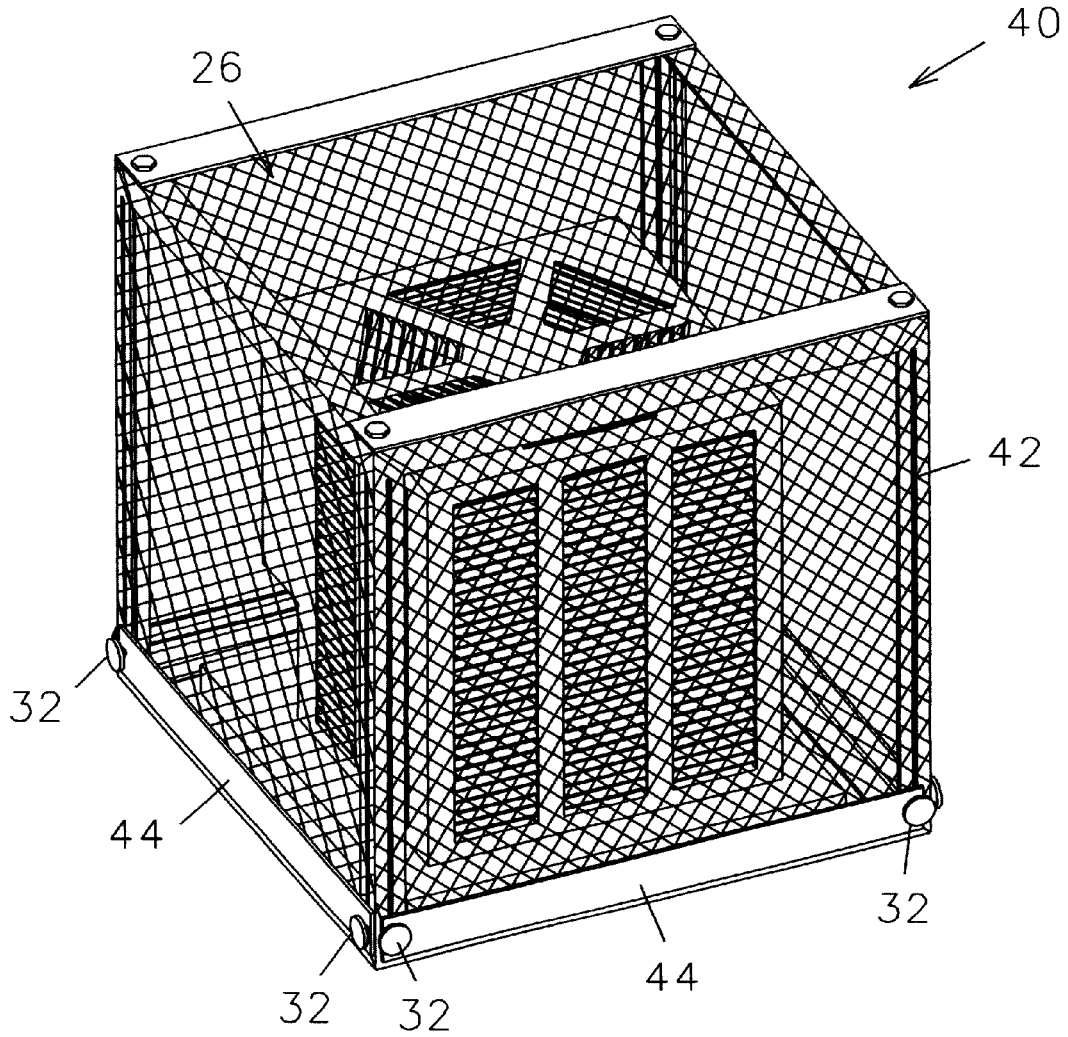
FIG. 5 is a perspective view of another embodiment of a protective cover according to the present invention.

Another embodiment of the protective cover 40 is shown in FIG. 5 and includes a construction substantially similar to that described above except as specifically pointed out below. In this embodiment, the mesh screen spans the outer faces of respective struts and supports, thereby completely shielding each vertical support slot 42 from debris. To accomplish this, respective slider bars 44 are positioned to the outside of corresponding vertical supports. Use of the apparatus according to this embodiment is substantially similar to that described previously.

Figure 6:
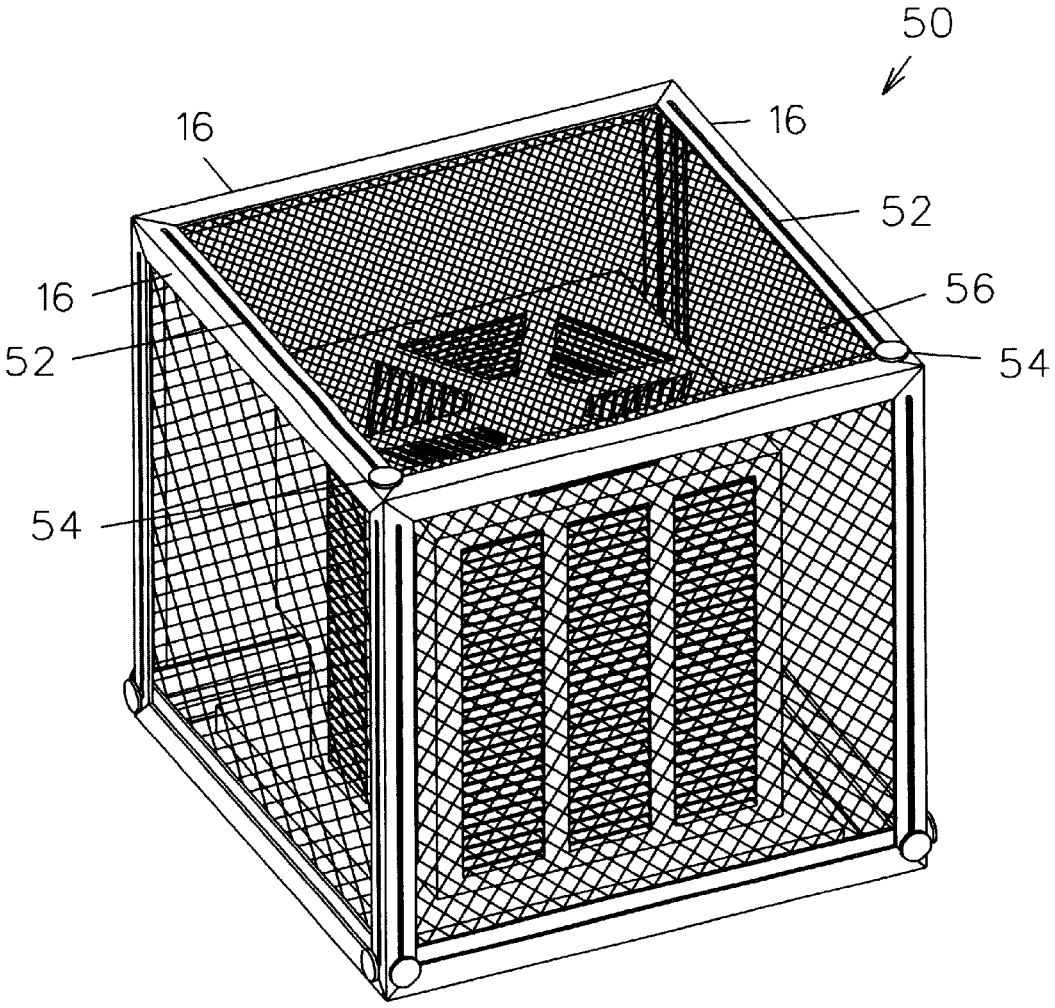
FIG. 6 is a perspective view of another embodiment of a protective cover according to the present invention.

Still another embodiment of the protective cover 50 according to the present invention is shown in FIG. 6 and includes a construction that is substantially similar to the embodiment first described except as specifically noted below. In this embodiment, a pair of opposed upper struts define elongate slots 52 in which knob fasteners 54 may be inserted. Only one edge of the top panel 56 of the mesh screen is fixedly attached to an upper strut. A slider bar is attached to an opposed edge thereof and is adapted to engage the pair of fasteners such that the top panel is selectively movable in the manner described previously for providing access to the air conditioning unit 8.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An adjustable protective cover for use with an air conditioning unit having a top and sides, said cover comprising:

a framework adapted to enclose said air conditioning unit, said framework comprising:

a plurality of spaced apart vertical supports, each vertical support having upper and lower ends;

a plurality of upper struts extending between respective upper ends of said vertical supports so as to form a generally square configuration;

a plurality of lower struts extending between respective lower ends of said vertical supports so as to form a generally square configuration;

a screen having a top portion and a plurality of side portions, said top portion spanning between said plurality of upper struts and each said side portion spanning between adjacent vertical supports and respective upper and lower struts;

wherein said screen includes a top portion and a plurality of side portions, said top portion spanning between said plurality of upper struts and said side portions depending from respective upper struts, a lower edge of each said side portion being adapted to be selectively movable between a respective lower strut and a respective upper strut whereby to selectively provide access to said sides of said air conditioner, an edge of said top portion being adapted to be selectively movable between a respective upper strut and an opposed upper strut whereby to selectively provide access to said top of said air conditioner.

2. An adjustable protective cover for use with an air conditioning unit having a top and sides, said cover comprising:

a framework adapted to surround said top and sides of said air conditioning unit, said framework comprising:

a plurality of spaced apart vertical supports, each vertical support having upper and lower ends;

a plurality of upper struts extending between respective upper ends of said vertical supports so as to form a generally square configuration;

a plurality of lower struts extending between respective lower ends of said vertical supports so as to form a generally square configuration;

a screen coupled to said framework in a manner whereby to shield said top and sides of said air conditioning unit from direct rays of sun and from debris, said screen being adapted to move slidably along said framework so as to selectively provide access to said sides of said air conditioning unit; and wherein said screen includes a top portion and a plurality of side portions, said top portion spanning between said plurality of upper struts and said side portions depending from respective upper struts whereby a lower edge of each said side portion is adapted to be selectively movable between a respective lower strut and a respective upper strut.

3. A protective cover as in claim 2 further comprising a plurality of slider bars, said plurality of slider bars being attached to respective lower edges of said side portions of said screen adjacent respective lower struts and having ends slidably coupled to respective vertical supports.

4. A protective cover as in claim 2 further comprising means for holding selected slider bars in a desired position between corresponding upper and lower struts.

5. An adjustable protective cover for use with an air conditioning unit having a top and sides, said cover comprising:

a framework adapted to enclose said air conditioning unit, said framework comprising:

a plurality of spaced apart vertical supports, each vertical support having upper and lower ends;

a plurality of upper struts extending between respective upper ends of said vertical supports so as to form a generally square configuration;

a plurality of lower struts extending between respective lower ends of said vertical supports so as to form a generally square configuration;

a screen having a top portion and a plurality of side portions, said top portion spanning between said plurality of upper struts and each said side portion spanning between adjacent vertical supports and respective upper and lower struts;

wherein each vertical support includes an L-shaped configuration having a pair of faces normal to each other, each face defining a slot extending longitudinally between said upper and lower ends of each said vertical support; and at least one fastener adapted to slide along a respective slot, said at least one fastener coupled to a corresponding side portion of said screen for moving said corresponding side portion between an open and closed configuration relative to respective upper and lower struts upon a movement of a respective fastener along a respective slot.

6. A protective cover as in claim 5 further comprising a plurality of slider bars, each slider bar being attached to a lower edge of a respective side portion of said screen adjacent a respective lower strut and extending between respective vertical supports, each said slider bar defining at least one aperture adjacent an end thereof for threadably engaging a corresponding fastener whereby to releasably couple said slider bar to a corresponding vertical support.

7. A protective cover as in claim 6 wherein each said slider bar is movable between respective upper and lower struts upon a movement of said at least one fastener along a respective slot.

8. A protective cover as in claim 7 further comprising means for holding selected side bars in a desired position between corresponding upper and lower struts.

9. A protective cover as in claim 5 wherein a pair of opposed upper struts define slots extending longitudinally therealong, respectively;

said protective cover further comprising at least another fastener adapted to slide along a respective slot in said opposed upper struts, said another fastener being coupled to an edge of said top portion of said screen for moving said top portion between an open and closed configuration upon a movement of said another fastener in said respective slot.

10. A protective cover as in claim 5 wherein said screen completely spans outer surfaces of said vertical supports and said upper and lower struts, whereby said slots are shielded by said side portions of said screen at said closed configuration.

* * * * *